US009034112B2

(12) United States Patent
Tuller et al.

(10) Patent No.: US 9,034,112 B2
(45) Date of Patent: May 19, 2015

(54) DISHWASHER WITH SHARED HEATER

(75) Inventors: Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1148 days.

(21) Appl. No.: 12/959,483

(22) Filed: Dec. 3, 2010

(65) Prior Publication Data

US 2012/0138096 A1 Jun. 7, 2012

(51) Int. Cl.

*A47L 15/42* (2006.01)
*A47L 15/00* (2006.01)
*A47L 15/48* (2006.01)

(52) U.S. Cl.

CPC ..... *A47L 15/4285* (2013.01); *A47L 15/0047* (2013.01); *A47L 15/0049* (2013.01); *A47L 15/488* (2013.01); *A47L 2401/06* (2013.01); *A47L 2401/18* (2013.01); *A47L 2401/22* (2013.01); *A47L 2501/06* (2013.01); *A47L 2501/11* (2013.01)

(58) Field of Classification Search

CPC ..... A47L 15/0047; A47L 15/0049; A47L 15/4285; A47L 15/488; A47L 2501/11; A47L 2501/18; A47L 2501/22; A47L 2501/06
USPC ..... 134/56 R
See application file for complete search history.

(56) References Cited

U.S. PATENT DOCUMENTS

| | | | | |
|---|---|---|---|---|
| 1,617,021 | A | | 2/1927 | Mitchell |
| 2,154,559 | A | | 4/1939 | Bilde |
| 2,422,022 | A | | 6/1947 | Koertge |
| 2,734,122 | A | | 2/1956 | Flannery |
| 3,016,147 | A | | 1/1962 | Cobb et al. |
| 3,026,628 | A | | 3/1962 | Berger, Sr. et al. |
| 3,068,877 | A | | 12/1962 | Jacobs |
| 3,103,227 | A | | 9/1963 | Long |
| 3,122,148 | A | | 2/1964 | Alabaster |
| 3,186,417 | A | | 6/1965 | Fay |
| 3,288,154 | A | | 11/1966 | Jacobs |
| 3,542,594 | A | | 11/1970 | Smith et al. |
| 3,575,185 | A | | 4/1971 | Barbulesco |
| 3,586,011 | A | | 6/1971 | Mazza |
| 3,739,145 | A | * | 6/1973 | Woehler ..... 392/441 |
| 3,801,280 | A | | 4/1974 | Shah et al. |
| 3,846,321 | A | | 11/1974 | Strange |
| 3,906,967 | A | * | 9/1975 | Bergeson ..... 134/104.4 |
| 3,989,054 | A | | 11/1976 | Mercer |
| 4,179,307 | A | | 12/1979 | Cau et al. |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for Counterpart DE102013109125, Dec. 9, 2013.

(Continued)

*Primary Examiner* — Jeffrey T Barton
*Assistant Examiner* — Tae-Sik Kang

(57) ABSTRACT

An automatic dishwasher having a heater shared by the recirculation system and the air supply system to heat the liquid in the recirculation system and the air in the air supply system.

24 Claims, 6 Drawing Sheets

(56) References Cited

U.S. PATENT DOCUMENTS

| | | | | |
|---|---|---|---|---|
| 4,180,095 | A | 12/1979 | Woolley et al. | |
| 4,326,552 | A | 4/1982 | Bleckmann | |
| 4,754,770 | A | 7/1988 | Fornasari | |
| 5,002,890 | A | 3/1991 | Morrison | |
| 5,030,357 | A | 7/1991 | Lowe | |
| 5,133,863 | A | 7/1992 | Zander | |
| 5,331,986 | A | 7/1994 | Lim et al. | |
| 5,454,298 | A | 10/1995 | Lu | |
| 5,470,142 | A | 11/1995 | Sargeant et al. | |
| 5,470,472 | A | 11/1995 | Baird et al. | |
| 5,557,704 | A * | 9/1996 | Dennis et al. | 392/480 |
| 5,569,383 | A | 10/1996 | Vander Ark, Jr. et al. | |
| 5,618,424 | A | 4/1997 | Nagaoka | |
| 5,711,325 | A | 1/1998 | Kloss et al. | |
| 5,755,244 | A | 5/1998 | Sargeant et al. | |
| 5,782,112 | A | 7/1998 | White et al. | |
| 5,803,100 | A | 9/1998 | Thies | |
| 5,865,997 | A | 2/1999 | Isaacs | |
| 5,868,937 | A | 2/1999 | Back et al. | |
| 5,904,163 | A | 5/1999 | Inoue et al. | |
| 5,924,432 | A | 7/1999 | Thies et al. | |
| 6,289,908 | B1 | 9/2001 | Kelsey | |
| 6,389,908 | B1 | 5/2002 | Chevalier et al. | |
| 6,460,555 | B1 | 10/2002 | Tuller et al. | |
| 6,491,049 | B1 | 12/2002 | Tuller et al. | |
| 6,601,593 | B2 | 8/2003 | Deiss et al. | |
| 6,666,976 | B2 | 12/2003 | Benenson, Jr. et al. | |
| 6,800,197 | B1 | 10/2004 | Kosola et al. | |
| 6,997,195 | B2 | 2/2006 | Durazzani et al. | |
| 7,047,986 | B2 | 5/2006 | Ertle et al. | |
| 7,069,181 | B2 | 6/2006 | Jerg et al. | |
| 7,093,604 | B2 | 8/2006 | Jung et al. | |
| 7,153,817 | B2 | 12/2006 | Binder | |
| 7,198,054 | B2 | 4/2007 | Welch | |
| 7,208,080 | B2 | 4/2007 | Batten et al. | |
| 7,232,494 | B2 | 6/2007 | Rappette | |
| 7,250,174 | B2 | 7/2007 | Lee et al. | |
| 7,270,132 | B2 | 9/2007 | Inui et al. | |
| 7,319,841 | B2 | 1/2008 | Bateman, III et al. | |
| 7,326,338 | B2 | 2/2008 | Batten et al. | |
| 7,347,212 | B2 | 3/2008 | Rosenbauer | |
| 7,350,527 | B2 | 4/2008 | Gurubatham et al. | |
| 7,363,093 | B2 | 4/2008 | King et al. | |
| 7,406,843 | B2 | 8/2008 | Thies et al. | |
| 7,445,013 | B2 | 11/2008 | VanderRoest et al. | |
| 7,497,222 | B2 | 3/2009 | Edwards et al. | |
| 7,523,758 | B2 | 4/2009 | VanderRoest et al. | |
| 7,594,513 | B2 | 9/2009 | Vanderroest et al. | |
| 7,819,983 | B2 | 10/2010 | Kim et al. | |
| 7,896,977 | B2 | 3/2011 | Gillum et al. | |
| 8,043,437 | B1 | 10/2011 | Delgado et al. | |
| 8,161,986 | B2 | 4/2012 | Alessandrelli | |
| 8,215,322 | B2 | 7/2012 | Fountain et al. | |
| 8,667,974 | B2 | 3/2014 | Fountain et al. | |
| 8,746,261 | B2 | 6/2014 | Welch | |
| 2002/0017483 | A1 | 2/2002 | Chesner et al. | |
| 2003/0037809 | A1 | 2/2003 | Favaro | |
| 2003/0205248 | A1 | 11/2003 | Christman et al. | |
| 2004/0007253 | A1 | 1/2004 | Jung et al. | |
| 2004/0103926 | A1 | 6/2004 | Ha | |
| 2005/0022849 | A1 | 2/2005 | Park et al. | |
| 2005/0133070 | A1 | 6/2005 | Vanderroest et al. | |
| 2006/0005863 | A1 | 1/2006 | Gurubatham et al. | |
| 2006/0123563 | A1 | 6/2006 | Raney et al. | |
| 2006/0162744 | A1 | 7/2006 | Walkden | |
| 2006/0174915 | A1 | 8/2006 | Hedstrom et al. | |
| 2006/0236556 | A1 * | 10/2006 | Ferguson et al. | 34/73 |
| 2006/0237049 | A1 | 10/2006 | Weaver et al. | |
| 2007/0006898 | A1 | 1/2007 | Lee | |
| 2007/0107753 | A1 | 5/2007 | Jerg | |
| 2007/0163626 | A1 | 7/2007 | Klein | |
| 2007/0186964 | A1 | 8/2007 | Mason et al. | |
| 2007/0246078 | A1 | 10/2007 | Purtilo et al. | |
| 2007/0266587 | A1 | 11/2007 | Bringewatt et al. | |
| 2008/0116135 | A1 | 5/2008 | Rieger et al. | |
| 2008/0289654 | A1 | 11/2008 | Kim et al. | |
| 2008/0289664 | A1 | 11/2008 | Rockwell et al. | |
| 2009/0095330 | A1 | 4/2009 | Iwanaga et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043847 | A1 | 2/2010 | Yoon et al. | |
| 2010/0121497 | A1 | 5/2010 | Heisele et al. | |
| 2010/0154830 | A1 | 6/2010 | Lau et al. | |
| 2010/0154841 | A1 | 6/2010 | Fountain et al. | |
| 2010/0224223 | A1 | 9/2010 | Kehl et al. | |
| 2010/0252081 | A1 | 10/2010 | Classen et al. | |
| 2010/0300499 | A1 | 12/2010 | Han et al. | |
| 2011/0061682 | A1 | 3/2011 | Fountain et al. | |
| 2011/0120508 | A1 | 5/2011 | Yoon et al. | |
| 2011/0146714 | A1 | 6/2011 | Fountain et al. | |
| 2011/0146730 | A1 | 6/2011 | Welch | |
| 2011/0146731 | A1 | 6/2011 | Fountain et al. | |
| 2012/0097200 | A1 | 4/2012 | Fountain | |
| 2012/0118330 | A1 | 5/2012 | Tuller et al. | |
| 2012/0118336 | A1 | 5/2012 | Welch | |
| 2012/0138106 | A1 | 6/2012 | Fountain et al. | |
| 2012/0138107 | A1 | 6/2012 | Fountain et al. | |
| 2012/0291805 | A1 | 11/2012 | Tuller et al. | |
| 2012/0291822 | A1 | 11/2012 | Tuller et al. | |
| 2012/0318295 | A1 | 12/2012 | Delgado et al. | |
| 2012/0318296 | A1 | 12/2012 | Fountain et al. | |
| 2012/0318308 | A1 | 12/2012 | Fountain et al. | |
| 2012/0318309 | A1 | 12/2012 | Tuller et al. | |

FOREIGN PATENT DOCUMENTS

| | | | |
|---|---|---|---|
| CN | 2761660 | | 3/2006 |
| CN | 1966129 | A | 5/2007 |
| CN | 2907830 | | 6/2007 |
| CN | 101406379 | | 4/2009 |
| CN | 201276653 | | 7/2009 |
| CN | 201361486 | Y | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | | 6/2011 |
| DE | 102011052846 | A1 | 5/2012 |
| DE | 102012103435 | A1 | 12/2012 |

(56) References Cited

FOREIGN PATENT DOCUMENTS

| | | | |
|---|---|---|---|
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2075366 | A1 | 7/2009 |
| EP | 2127587 | A1 | 12/2009 |
| EP | 2138087 | A1 | 12/2009 |
| EP | 2332457 | A1 | 6/2011 |
| EP | 2335547 | | 6/2011 |
| EP | 2338400 | | 6/2011 |
| EP | 2351507 | | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 7178030 | A | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | A | 8/2001 |
| KR | 20090006659 | A | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

European Search Report for EP12188007, Aug. 6, 2013.
German Search Report for DE102013103264, Jul. 12, 2013.
German Search Report for DE102013103625, Jul. 19, 2013.
German Search Report for DE102010061343, Jul. 7, 2011.
German Search Report for DE102010061342, Aug. 19, 2011.
European Search Report for EP101952380, May 19, 2011.
German Search Report for DE102010061346, Sep. 30, 2011.
European Search Report for EP11188106, Mar. 29, 2012.
German Search Report for DE102010061347, Jan. 23, 2013.
German Search Report for DE102010061215, Feb. 7, 2013.
German Search Report for DE102011053666, Oct. 21, 2011.
Ishihara et al., JP 11155792 A, English Machine Translation, 1999, pp. 1-14.
German Search Report for Counterpart DE102014101260.7, Sep. 18, 2014.

* cited by examiner

DISHWASHER WITH SHARED HEATER

BACKGROUND OF THE INVENTION

Contemporary automatic dishwashers for use in a typical household include a tub for receiving soiled utensils to be cleaned. A spray system and a recirculation system may be provided for re-circulating liquid throughout the tub to remove soils from the utensils. An air supply system may be included to provide air to the tub for drying the utensils. The dishwasher may have a controller that implements a number of pre-programmed cycles of operation to wash utensils contained in the tub.

SUMMARY OF THE INVENTION

The invention relates to an automatic dishwasher with a recirculation system, an air supply system, and a heater. Where the heater is shared by the recirculation system and the air supply system such that the heater heats the liquid recirculated by the recirculation system and heats the air in the air supply system. The heater may be configured to simultaneously or selectively heat the liquid and the air.

DESCRIPTION OF EMBODIMENTS OF THE INVENTION

Figure 1:
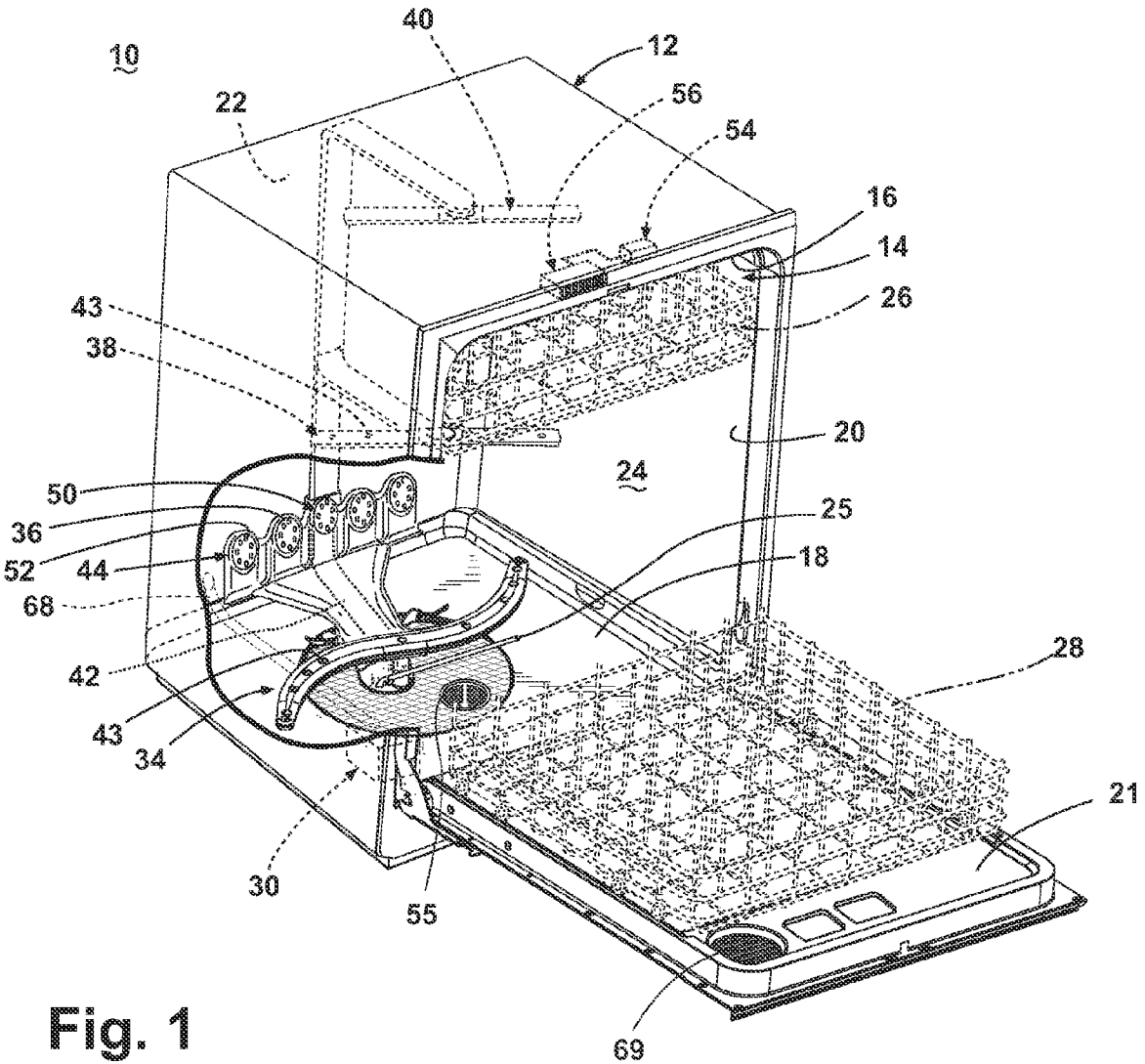
FIG. 1 is a perspective view of a dishwasher in accordance with a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention.

The cabinet 12 encloses a wash tub 14 at least partially defining a treating chamber 24 for holding utensils for washing according to a cycle of operation. While typically made from a single piece, the wash tub 14 has spaced top and bottom walls 16 and 18, spaced sidewalls 20, a front wall 21, and a rear wall 22. In this configuration, the walls 16, 18, 20, 21, and 22 collectively define the treating chamber 24 for washing utensils. The front wall 21 may be a door of the dishwasher 10, which may be pivotally attached to the dishwasher 10 for providing accessibility to the treating chamber 24 for loading and unloading utensils or other washable items.

Utensil holders in the form of upper and lower utensil racks 26, 28 are located within the treating chamber 24 and receive utensils for washing. The upper and lower racks 26, 28 may be mounted for slidable movement in and out of the treating chamber 24 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

Figure 2:
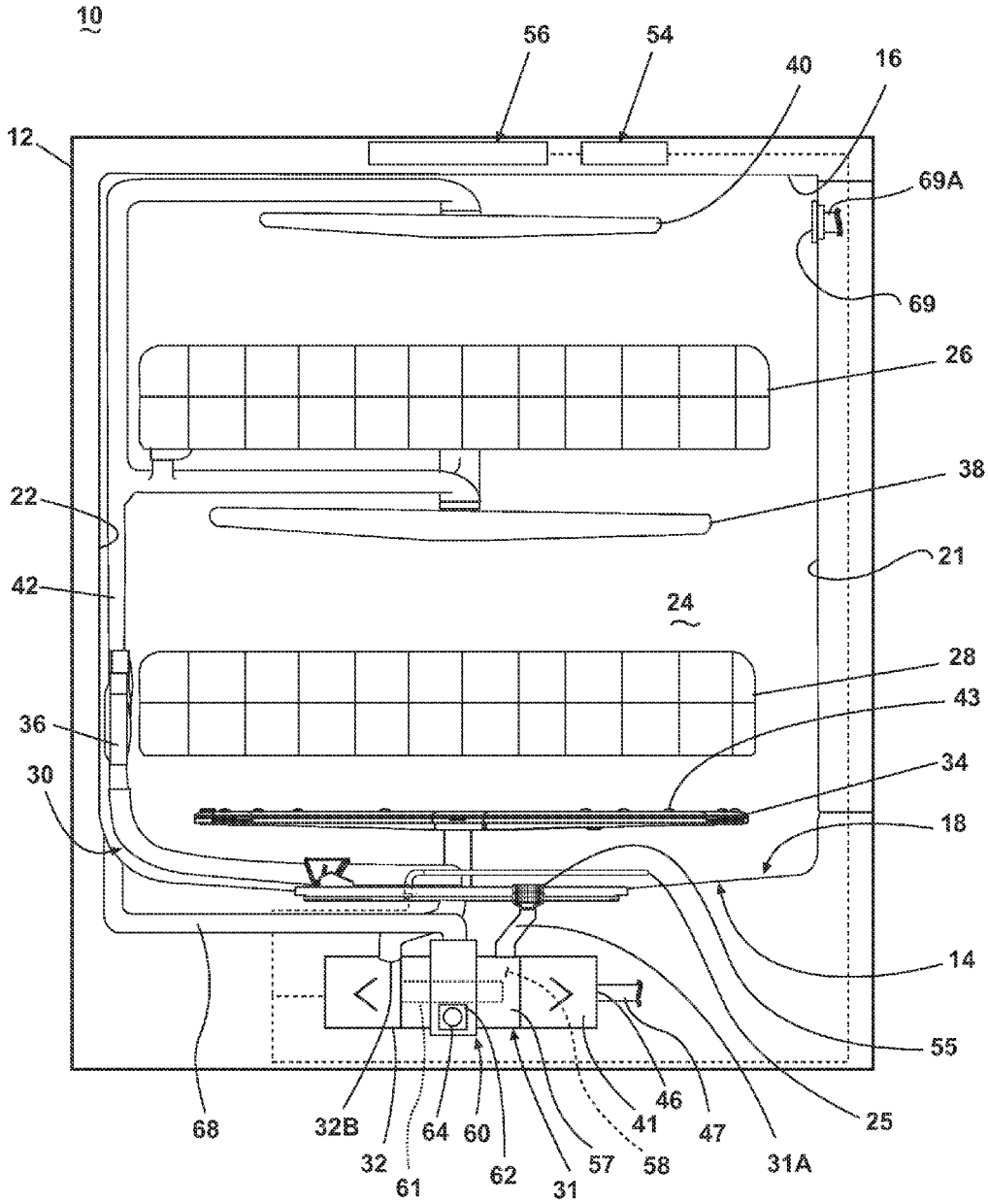
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. A recirculation system 30 is provided for spraying liquid within the treating chamber 24 to treat any utensils located therein. An air supply system 60 is provided for supplying air to the treating chamber 24 for aiding in the drying of the utensils. The recirculation system further comprises a wash unit 31 that is operably coupled to the recirculation system 30 and the air supply system 60, such that it provides pumping for the recirculation system 30, and heating for the both the recirculation system 30 and the air supply system 60, along with a draining function. Further, a heater 25 may be located in the treating chamber 24 near the bottom wall 18 to heat liquid in the treating chamber 24.

The recirculation system 30 comprises one or more sprayers for spraying liquid within the treating chamber 24. As illustrated, there are four sprayers: a first lower spray assembly 34, a second lower spray assembly 36, a mid-level spray assembly 38, and an upper spray assembly 40, which are supplied liquid from a supply tube 42. One or more valves may be provided with the supply tube 42 to control the flow of liquid to the various sprayers. In this way, liquid may be selectively supplied to a subset of all of the sprayers and/or simultaneously to all of the sprayers.

The first lower spray assembly 34 is positioned above the bottom wall 18 and beneath the lower utensil rack 28. The first lower spray assembly 34 is an arm configured to rotate in the wash tub 14 and spray a flow of liquid from a plurality of spray nozzles or outlets 43, in a primarily upward direction, over a portion of the interior of the wash tub 14. A first wash zone may be defined by the spray field emitted by the first lower spray assembly 34 into the treating chamber 24. The spray from the first lower spray assembly 34 is sprayed into the wash tub 14 in typically upward fashion to wash utensils located in the lower utensil rack 28. The first lower spray assembly 34 may optionally also provide a liquid spray downwardly onto the lower tub region 29, but for purposes of simplification, this will not be illustrated or described herein.

The second lower spray assembly 36 is illustrated as being located adjacent the lower rack 28 toward the rear of the treating chamber 24. The second lower spray assembly 36 is illustrated as including a horizontally oriented distribution header or spray manifold 44 having a plurality of nozzles 50, each with a plurality of apertures 52. The spray manifold 44 may not be limited to this position; rather, the spray manifold 44 could be located in virtually any part of the treating chamber 24. Alternatively, the manifold 44 could be positioned underneath the lower rack 28, adjacent or beneath the first lower spray assembly 34. Such a spray manifold is set forth in detail in U.S. Pat. No. 7,594,513, issued Sep. 29, 2009, and titled "Multiple Wash Zone Dishwasher," which is incorporated herein by reference in its entirety.

The second lower spray assembly 36 may be configured to spray a flow of treating liquid from the apertures 52, in a generally lateral direction, over a portion of the interior of the treating chamber 24. The spray from the apertures 52 may be typically directed to treat utensils located in the lower rack 28. A second wash zone may be defined by the spray field emitted by the second lower spray assembly 36 into the treating chamber 24. When both the first lower spray assembly 34 and the second lower spray assembly 36 emit spray fields the first and second zones may intersect.

The mid-level spray arm assembly 38 is positioned between the upper utensil rack 26 and the lower utensil rack 28. Like the first lower spray assembly 34, the mid-level spray assembly 38 may also be configured to rotate in the dishwasher 10 and spray a flow of liquid from at least one outlet 43, in a generally upward direction, over a portion of the interior of the wash tub 14. In this case, the spray from the mid-level spray arm assembly 38 is directed to utensils in the upper utensil rack 26 to define a third spray zone. In contrast, the upper spray arm assembly 40 is positioned above the upper utensil rack 26 and generally directs a spray of liquid in a generally downward direction to define a fourth spray zone that helps wash utensils on both upper and lower utensil racks 26, 28.

The wash unit 31 comprises a wash or recirculation pump 32 and a drain pump 41, which are fluidly coupled to a housing 57 defining a sump 58, where liquid sprayed into the wash tub 14 will collect due to gravity. As illustrated, the housing 57 is physically separate from the wash tub 14 and provides a mounting structure for the recirculation pump 32 and drain pump 41. An inlet conduit 31A fluidly couples the wash tub 14 to the housing 57 and provides a path for the liquid in the treating chamber 24 to travel to the sump 58. As illustrated, the recirculation pump 32 fluidly couples the sump 58 to the supply tube 42 to effect a supplying of the liquid from the sump 58 to the sprayers. As illustrated, the drain pump 41 fluidly couples to a drain pump outlet 46 to effect a supplying of liquid from the sump to a household drain 47.

The inlet conduit 31A, sump 58, recirculation pump 32, spray assemblies 34-40, and supply tube 42 collectively form a liquid flow path in the recirculation system 30. A filter may be located somewhere within the liquid flow path such that soil and foreign objects may be filtered from the liquid. As an example, a filter 55 has been illustrated as being located inside the inlet conduit 31A such that soil and debris may be filtered from the liquid as it travels from an opening in the lower portion 29 of the bottom wall 18 to the sump 58. The filter 55 may be a strainer, which may be employed to retain larger soil particles but allows smaller particles to pass through. An optional filter element 61 has been illustrated in FIG. 2 as being located within the housing 57 between the inlet conduit 31A and the recirculation pump 32.

The recirculation pump 32 may be fluidly coupled to the recirculation path such that it draws liquid in through the inlet conduit 31A and sump 58 and delivers it to one or more of the spray assemblies 34-40 through the supply tube 42. One or more valves or diverters (not shown) may also be included in the dishwasher 10 to control the flow of liquid to the spray assemblies 34-40 from the recirculation pump 32. The liquid is sprayed back into the treating chamber 24 through the spray assemblies 34-40 and drains back to the sump 58 where the process may be repeated. Thus, a liquid flow path fluidly couples the treating chamber 24 to the spray assemblies 34-40.

The drain pump 41 may also be fluidly coupled to the housing 57. The drain pump 41 may be adapted to draw liquid from the housing 57 and to pump the liquid through a drain pump outlet 46 to a household drain 47. As illustrated, the dishwasher 10 includes a recirculation pump 32 and a drain pump 41. Alternatively, it is possible for the two pumps to be replaced by a single pump, which may be operated to supply to either the household drain or to the recirculation system.

The air supply system 60 comprises an inlet duct 68 coupled to the wash tub 14, with an inlet 64 located below the bottom wall 18 such that air exterior to the tub 14, i.e., "ambient air", may be provided to the treating chamber 24. A fan or blower 62 is fluidly coupled to the inlet duct 68 through an air supply conduit 66 to draw in the ambient air through the inlet 64 and supply it to the treating chamber 24 through the air supply conduit 66 and air inlet duct 68. An air outlet, such as a vent 69, is provided for exhausting the supplied air from the treating chamber 24. As illustrated, the vent 69 is fluidly coupled to an outlet duct 69A, which vents into the interior of the door 21 and will escape through the various openings in the door 21. However, the outlet duct 69A may extend completely through the door 21. It should be noted that a flap or other means (not shown) may be used to close off the fluid connection between the outlet duct 68 and the wash tub 14 during certain portions of the cycle of operation so that liquid does not enter the outlet duct 68.

A control panel or user interface 56 provided on the dishwasher 10 and coupled to a controller 54 may be used to select a cycle of operation. The user interface 56 may be provided on the cabinet 12 or on the outer panel of the door and can include operational controls such as dials, lights, switches, and displays enabling a user to input commands to the controller 54 and receive information about the selected cycle of operation. The dishwasher 10 may further include other conventional components such as additional valves, a dispensing system for dispensing treating chemistries or rinse aids, spray arms or nozzles, etc.; however, these components are not germane to the present invention and will not be described further herein.

Figure 3:
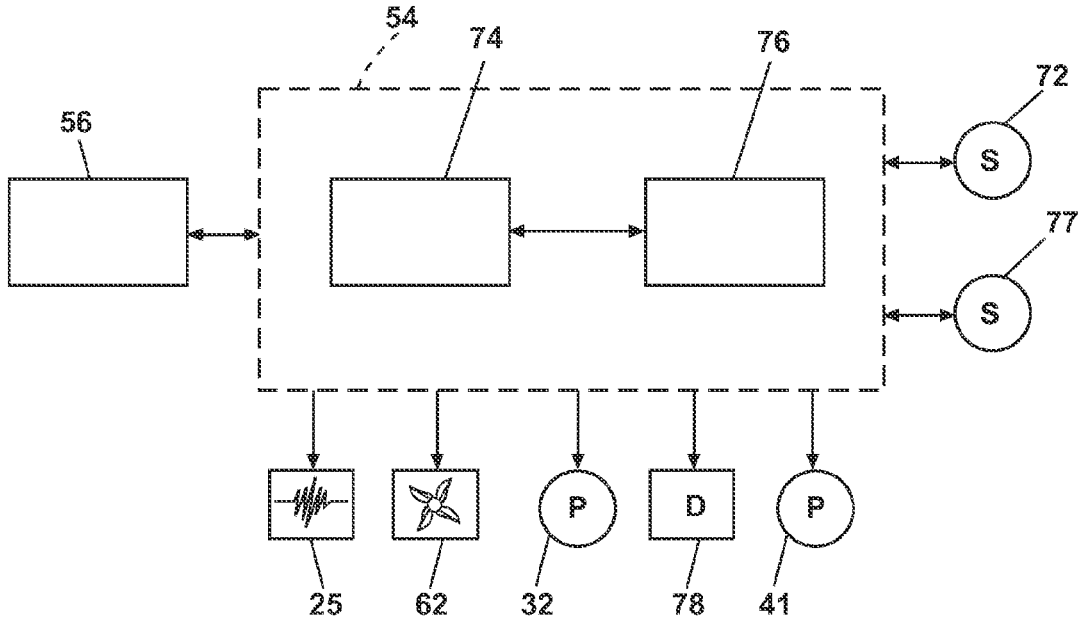
FIG. 3 is a schematic view of a control system of the dishwasher of FIG. 1.

As illustrated in FIG. 3, the controller 54 may be provided with a memory 74 and a central processing unit (CPU) 76. The memory 74 may be used for storing control software that may be executed by the CPU 76 in completing a cycle of operation using the dishwasher 10 and any additional software. For example, the memory 74 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 54 may be operably coupled with one or more components of the dishwasher 10 for communicating with and controlling the operation of the components to complete a cycle of operation. For example, the controller 54 may be coupled with the recirculation pump 32 for circulation of liquid in the wash tub 14 and the drain pump 41 for drainage of liquid in the wash tub 14. The controller 54 may also be operably coupled with the blower 62 to provide air into the wash tub 14.

Further, the controller 54 may also be coupled with one or more temperature sensors 72, which are known in the art and not shown for simplicity, such that the controller 54 may control the duration of the steps of the cycle of operation based upon the temperature detected. The controller 54 may also receive inputs from one or more other optional sensors 77, which are known in the art and not shown for simplicity. Non-limiting examples of optional sensors 77 that may be communicably coupled with the controller 54 include a moisture sensor, a door sensor, a detergent and rinse aid presence/type sensor(s). The controller 54 may also be coupled to a dispenser 78, which may dispense a detergent during the wash step of the cycle of operation or a rinse aid during the rinse step of the cycle of operation.

During operation of the dishwasher 10, the recirculation system 30 may be employed to provide liquid to one or more of the spray assemblies 34-40. Liquid in the wash tub 14 passes into the housing 57 where it may collect in the sump 58. At an appropriate time during the cycle of operation to spray liquid into the treating chamber 24, the controller 55 signals the recirculation pump 32 to supply liquid to one or more of the spray assemblies 34-40. The recirculation pump 32 draws liquid from the sump 58 through the filter element 61 and the recirculation pump 32 where it may then be delivered to one or more of the spray assemblies 34-40 through the supply tube 42 and any associated valving.

Figure 4:
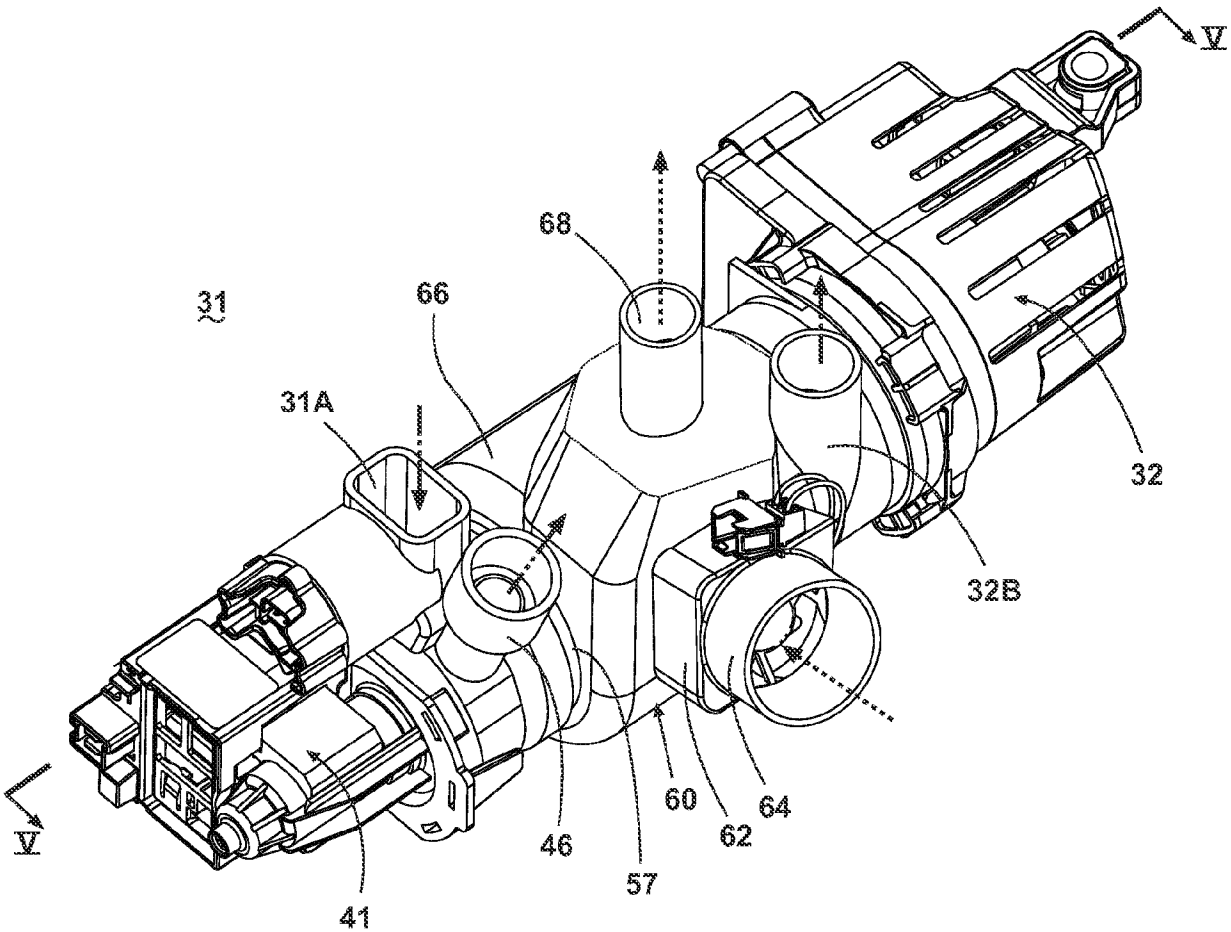
FIG. 4 is a perspective view of one embodiment of the shared wash unit and its couplings to the recirculation system and air supply system illustrated in FIG. 2.

FIG. 4 illustrates a perspective view of one embodiment of the wash unit 31 integrated with the air supply system 60. The wash unit 31 has a drain pump 41 and recirculation pump 32 mounted to the housing 57. The air supply conduit 66 of the air supply system 60 wraps around the housing 57, with the blower 62 located within the air supply conduit 66 just inside the inlet 64.

Figure 5:
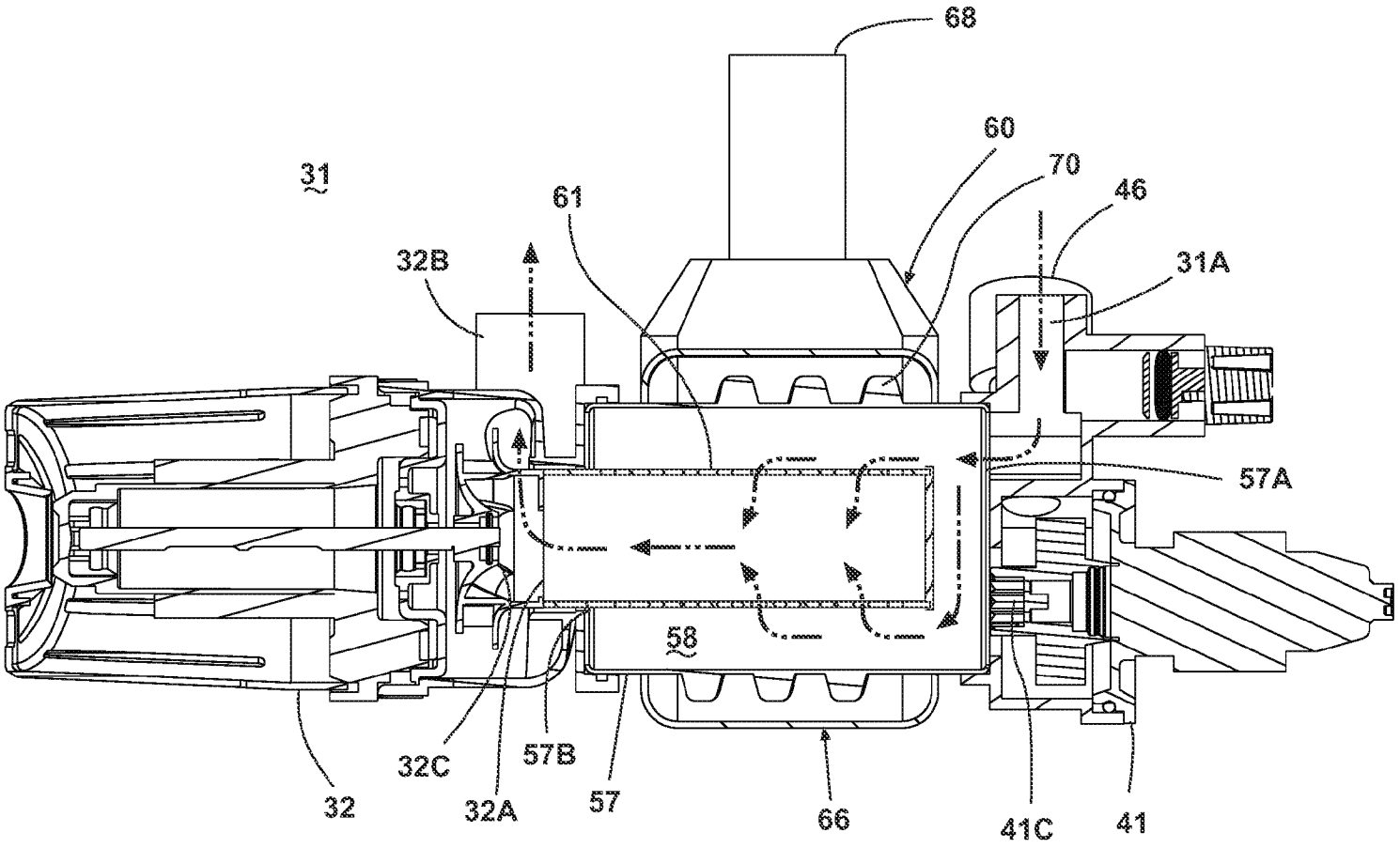
FIG. 5 is a cross-sectional view of the shared wash unit and illustrating a heater that is shared by the recirculation system and air supply system illustrated in FIG. 4.

Referring to FIG. 5, the housing 57 may have a housing inlet 57A and a housing outlet 57B. A filter element 61 located in the housing 57 and fluidly disposed between the housing inlet 57A and housing outlet 57B to filter liquid passing through the sump 58. Because the housing 57 is located within the cabinet 12 but physically remote from the wash tub 14, the filter element 61 is not directly exposed to the wash tub 14. In this manner, the housing 57 and filter element 61 may be thought of as defining a filter unit, which is separate and remote from the wash tub 14.

The filter element 61 may be a fine filter, which may be utilized to remove smaller particles from the liquid. The filter element 61 may be a rotating filter and such a rotating filter is set forth in detail in U.S. patent application Ser. No. 12/643,394, filed Dec. 21, 2009, and titled "Rotating Drum Filter for a Dishwashing Machine," which is incorporated herein by reference in its entirety. The rotating filter according to U.S. patent application Ser. No. 12/643,394 may be operably coupled to an impeller 32C of the recirculation pump 32 such that when the impeller 32C rotates the filter element 61 is also rotated.

The recirculation pump 32 may be adapted to draw liquid from the housing outlet 57B in through an inlet 32A and to pump the liquid out through an outlet 32B to the sprayers. The directional arrows in FIG. 5 illustrate the liquid flowing into the housing 57 and the sump 58 where it may then be drawn through the filter element 61 and the recirculation pump 32 when the recirculation pump 32 is operated. In this manner, the filter element 61 fluidly separates the housing 57 from the inlet 32A of the recirculation pump 32. The drain pump 41 may also be fluidly coupled to the housing 57. The drain pump 41 includes an impeller 41C which may draw liquid from the housing 57 and pump it through a drain pump outlet 46 to a household drain 47 (FIG. 2). The filter element 61 is not fluidly disposed between the housing inlet 57A and the drain pump outlet 46 such that unfiltered liquid may be removed from the sump 58.

The housing 57 has been illustrated as being located inside the air supply conduit 66. This may also be described as the air supply conduit 66 wrapping around the cylindrical housing 57 such that the housing 57 becomes an inside wall of the air supply conduit 66. In this manner, the housing 57 is a shared wall of the recirculation system 30 and the air supply conduit 66. A heater 70 may be operably coupled to the controller 54 and may be positioned such that it is mounted to the housing 57 and shared by the recirculation system 30 and the air supply system 60. More specifically, it has been illustrated that the heater 70 is mounted to an exterior of the housing 57 where the air supply conduit 66 wraps around the cylindrical housing 57. In this location, the heater 70 may provide heated air and heated liquid into the wash tub 14 at the same time or may provide heated air and heated liquid into the wash tub 14 separately. Alternatively, it has been contemplated that the heater 70 may be mounted to an interior of the housing 57 or that portions of the heater 70 could be mounted on both the interior and the exterior of the housing 57.

The heater 70 is a variable thermal energy heater, which may be accomplished by altering the duty cycle (ratio of on/off states per unit time) of a fixed wattage heater, a variable wattage heater, or a combination of both. As illustrated, the heater 70 has three rings encircling the housing. The three rings may be an integral unit or independent. As an integral unit, the rings could be part of a heating coil that uses a variable duty cycle to vary the thermal energy output by the heater 70. As independent rings, the desired numbers of rings could be selectively actuated to obtain the desired thermal energy output. For example, if the heater is to run at ⅓ thermal energy output, then only one of the three rings could be continuously actuated. A combination of both approaches could be used such as continuously running a subset of all of the rings, while operating another one or more of the rings according to a duty cycle.

In addition to a coiled heater or multiple ring heater, other heater configurations may be used. For example, it has been contemplated that the heater 70 may be a film heater mounted on the housing 57. The film heater may be either a thin or thick film heater. The film heater may comprise one film or multiple films in much the same manner that the rings may be a coil or individual elements.

It has also been contemplated that the heater 70 may be mounted to the housing 57 and positioned such that it abuts a portion of the air supply conduit 66. In this manner, the air supply conduit 66 need not wrap fully around the housing 57. Instead, the air supply conduit 66 may abut or partially envelope the housing 57. In such an instance, the heater 70 may be mounted to the housing 57 where the air supply conduit 66 abuts or partially envelops the housing 57 such that the heater 70 may heat the liquid in the housing 57 and the air in the air supply conduit 66. It should be noted that while the blower 62 has been illustrated as being fluidly coupled with the air supply conduit 66 upstream from the heater 70 such that heated air does not pass through the blower 62, the blower 62 may also be located downstream from the heater 70 such that heated air is passed through the blower 62.

Further, the controller 54 may be coupled with the heater 70 such that it may be used to heat the liquid or heat the air depending on the step being performed in the cycle of operation. The controller 54 may be capable of operating the heater 70 at a variety of thermal energy output rates. The thermal energy output rate is a measurement of thermal output (power) by the heater 70 over time. The ability to control thermal energy output rates of the heater 70 is important because the liquid in the recirculation system, which is typically water, has a much greater density and latent heat, than the air of the air system, which means greater thermal output is required to change the temperature of the liquid as compared to the air, resulting in the liquid being capable of absorbing much more thermal energy than air alone.

In dishwashers, the thermal energy output of the heater 70 will typically be selected/sized to heat the recirculated liquid at a desired rate. Such a heater will typically be of a much greater size than needed to heat just the air in the air system. Thus, when the heater 70 is used to heat only the air, or heat the air without the presence of the liquid, the heater could easily over heat the air and/or provide too much thermal energy into the air system and the surrounding dishwasher.

The controller 54 can operate the heater 70 at a lower thermal energy output rate when only air is being heated to prevent the air from being over-heated. Such control of the heater 70 has the benefit of not wasting thermal energy, leading to a more efficient heating of the air alone.

In operation, the controller 54 may operate the heater 70 at a first thermal energy output rate when liquid is being recirculated and the controller 54 may operate the heater 70 at a second lower thermal energy output rate when only air is being supplied. Further, the controller 54 may operate the heater 70 at the first thermal energy output rate when liquid is being recirculated and air is being supplied. Alternatively, the controller 54 may operate the heater 70 a third thermal energy output rate that is even higher than the first thermal energy output rate to heat both the air and liquid at the same time.

Depending on the type of heater 70, as explained above, the controller 54 may be capable of operating the heater 70 in a variety of different ways to achieve different thermal energy outputs. For example, it has been contemplated that the thermal energy output rate of the heater 70 may be set by the controller 54 selecting a duty cycle of the heater 70. A first duty cycle may be set to achieve the first thermal energy output rate and a second duty cycle may be set to achieve the second thermal energy output rate. More specifically, when liquid is being recirculated, and the first thermal energy output rate is desired, the duty cycle may be set higher such that the heater 70 may be powered continuously. When only air is being heated, and the second thermal energy output rate is desired, the heater 70 may be set to a lower duty cycle to decrease the ratio of on/off states per unit time and limit the thermal energy output rate.

Alternatively, if the heater 70 is a variable wattage heater, then the thermal energy output rate of the heater 70 may be set by the controller 54 selecting a wattage for the heater 70 to operate at. More specifically, a first higher wattage may be selected to produce a first thermal energy output rate and a second lower wattage may be selected to produce a second lower thermal energy output rate. By way of non-limiting example, the heater 70 may be controlled to operate at around 900 watts when liquid is being heated and the controller 54 may decrease the wattage of the heater 70 down to 300 watts when only air is being heated.

As yet another alternative, if the heater 70 is composed of independent rings, the controller may achieve different thermal energy output rates by selectively actuating a desired number of rings. More specifically, when liquid is being recirculated and the first thermal energy output rate is desired the entire portion of the heater 70 or all three of the rings may be operated. When only air is being heated, and the second thermal energy output rate is desired, a smaller portion of the heater 70, or only one of the three rings may be operated. As yet another alternative, the controller 54 may continuously run a subset of all of the rings of the heater 70, while operating another one or more of the rings according to a duty cycle.

Thus, depending upon the cycle of operation being run, the controller 54 may operate the heater 70 at a first thermal energy output rate while the liquid is being recirculated to heat the liquid being supplied to the wash tub 14. Further, during operation of the dishwasher 10, the air supply system 60 may be employed to provide air to the treating chamber 24. At an appropriate time during the cycle of operation to introduce air into the wash tub 14 the controller 54 signals the blower 62 to supply air to the wash tub 14. Air may be supplied from the air inlet 64 of the blower 62 through the air supply conduit 66 and the outlet duct 68 into the treating chamber 24. Depending upon the cycle of operation being run, non-heated drying, also known as an air only drying, may be performed with the heater 70 being de-energized while air is supplied to the wash tub 14 from the air supply conduit 66 and the outlet duct 68. Alternatively, depending upon the cycle of operation being run, heated drying may be performed with the heater 70 being operated at a second thermal energy output by the controller 54 while air is supplied to the wash tub 14 from the air supply conduit 66 and the outlet duct 68. The controller 54 may also operate the heater 70 to heat the air being provided to the treating chamber 24 while liquid is being recirculated at the same time that the air is being supplied. In this case the controller 54 may operate the heater 70 at a third thermal energy output rate.

Regardless of whether the air is heated or not, the blower 62 may force air into the lower portion of the wash tub 14. The air travels upward within the treating chamber 24 and exits the treating chamber 24 through the vent 69 where it may be fluidly open to ambient air through a conduit 69*a*. In some configurations, an additional blower (not shown) may be provided to force air out the vent 69 to increase the drying speed. It has been contemplated that the air supply system 60 may be operated while the recirculation system 30 is also being operated. It has also been contemplated that the air supply system 60 may be operated separately to form a drying portion of the operational cycle.

Figure 6:
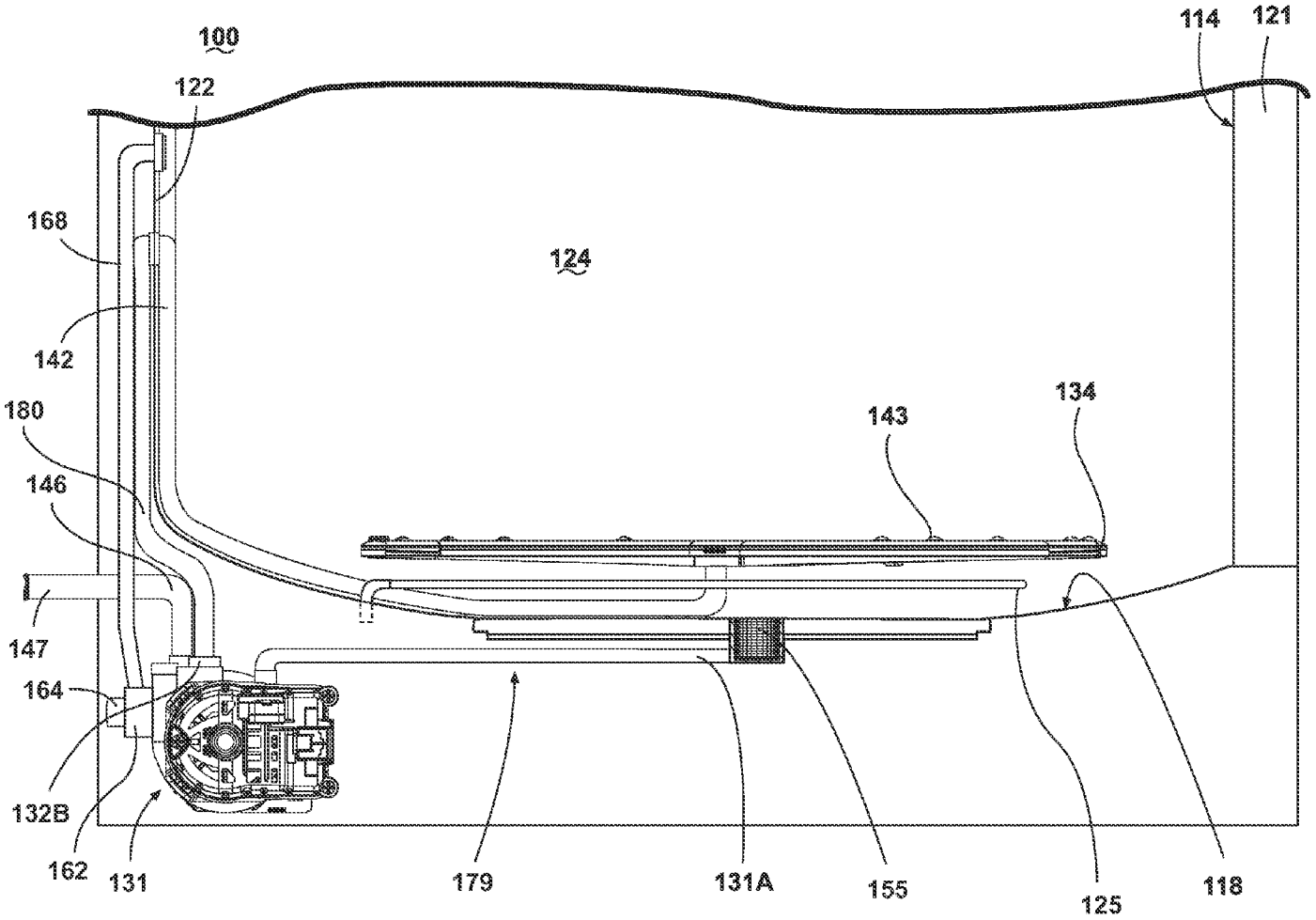
FIG. 6 is a cross-sectional view of a portion of a dishwasher in accordance with a second embodiment of the invention.

FIG. 6 illustrates a dishwasher 100 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted. FIG. 6 is identical to the embodiment shown in FIG. 2, having the specific wash unit as illustrated in FIG. 4, except that the wash unit 131, sump 158, and air supply system 160 are remote from the wash tub 114 in the dishwasher 100. Further, the dishwasher 100 includes a liquid coupling system 179, which aids in recirculating liquid collected in the remote sump 158 to the treating chamber 124. The liquid coupling system 179 is illustrated as including a first recirculation conduit 131A fluidly coupling the wash tub 114 to the housing 157 and a second recirculation conduit 180 fluidly coupling the recirculation pump outlet 132B to the wash tub 114. In all other ways, the embodiment of FIG. 6 is structured and operates in the same manner as the first embodiment illustrated in FIG. 2.

The embodiments of the invention described above allow for the integration of the air supply system and the recirculation system such that a single heater may be used to heat both the liquid and the air supplied to the tub. This results in a simple construction, which requires fewer parts to manufacture the dishwasher. Further, the embodiments of the invention described above remove the heater from the tub. This results in a heater which is not exposed to the user and prevents plastic items on the bottom rack from being melted.

The embodiments of the invention described above also allow for a compact assembly of the recirculation system and air supply system. The compact assembly may be more efficiently shielded. Another benefit that may be recognized from the more compact assembly is that a larger wash tub may be put in the housing. A larger wash tub may result in a larger capacity for utensils, which allows for more utensils to be washed at one time. This results in a saving of both time and energy as the dishwasher needs to be run fewer times to wash the same amount of utensils.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-6, such as by inclusion of other conduits, utensil racks, valves, spray assemblies, seals, and the like, to control the flow of liquid and the supply of air.

What is claimed is:

1. A dishwasher comprising:

a tub at least partially defining a treating chamber for receiving dishes;

a recirculation system comprising a wash unit having a housing, with an inlet fluidly coupled to the tub and an outlet fluidly coupled to the tub, and a filter element located in the housing and fluidly disposed between the inlet and outlet;

an air supply system having an air supply conduit fluidly coupled to the tub for supplying air to the tub and where the air supply conduit is fluidly separate from an interior of the housing; and a heater mounted to an outside of the housing and shared by the recirculation system and the air supply system to heat liquid in the housing and air in the air supply conduit.

2. The dishwasher of claim 1 wherein the housing and the air supply conduit comprise a shared wall and the heater is provided on the shared wall.

3. The dishwasher of claim 2 wherein the heater is a film heater mounted on the shared wall.

4. The dishwasher of claim 1 wherein the heater is mounted to an exterior of the housing.

5. The dishwasher of claim 1 wherein the housing comprises a wall and the air supply conduit at least partially envelopes the wall, and the heater is provided on the wall.

6. The dishwasher of claim 1 wherein the housing is remote from the tub.

7. The dishwasher of claim 6, further comprising a liquid coupling system having a first recirculation conduit fluidly coupling the tub to the housing inlet and a second recirculation conduit fluidly coupling the housing outlet to the tub.

8. The dishwasher of claim 1 wherein the recirculation system further comprises a recirculation pump having an inlet fluidly coupled to the housing and an outlet and wherein the filter fluidly separates the housing from the pump inlet.

9. The dishwasher of claim 8, wherein the filter is a rotating filter and is mounted to an impeller of the recirculation pump to effect the rotation of the filter.

10. The dishwasher of claim 1 wherein the air supply conduit comprises an inlet fluidly open to air in the dishwasher.

11. The dishwasher of claim 1 further comprising an outlet fluidly open to ambient air.

12. The dishwasher of claim 1, wherein the air supply system comprises a blower fluidly coupled with the air supply conduit to supply air to the tub and the blower is operably coupled to the air supply conduit upstream from the heater.

13. A dishwasher comprising:

a tub at least partially defining a treating chamber for receiving dishes;

a sump having a housing, with an inlet fluidly coupled to the tub and an outlet fluidly coupled to the tub, and collecting liquid supplied to the tub;

a recirculation system fluidly coupling the housing and the tub to recirculate the liquid;

an air supply system having an air supply conduit at least partially enveloping the housing and fluidly coupled to the tub; and a heater provided on a portion of an exterior of the housing enveloped by the air supply conduit;

wherein the air supplied to the tub through the air supply conduit and the liquid in the sump are heated by the heater.

14. The dishwasher of claim 13 wherein the housing is remote from the tub.

15. The dishwasher of claim 14, further comprising a liquid coupling system having a first recirculation conduit fluidly coupling the tub to the housing inlet and a second recirculation conduit fluidly coupling the housing outlet to the tub.

16. The dishwasher of claim 13 wherein the recirculation system comprises a recirculation pump fluidly coupled to the housing.

17. The dishwasher of claim 13 wherein the air supply conduit wraps around the housing.

18. The dishwasher of claim 13 wherein the housing is cylindrical and the air supply conduit wraps around the cylindrical housing.

19. The dishwasher of claim 18 wherein the heater is provided on the cylindrical housing where the air supply conduit wraps around the housing.

20. The dishwasher of claim 18 wherein the heater is a film heater mounted on the cylindrical housing.

21. The dishwasher of claim 13 wherein the heater is capable of supplying different wattages for heating of the supplied air and the liquid.

22. The dishwasher of claim 13 wherein the air supply system comprises a blower fluidly coupled with the air supply conduit to supply air to the tub and the blower is operably coupled to the air supply conduit upstream from the heater.

23. The dishwasher of claim 13 wherein the air supply system comprises an inlet fluidly open to air in the dishwasher.

24. The dishwasher of claim 13, further comprising an outlet fluidly open to ambient air.

* * * * *